US007465206B2

(12) United States Patent
Matsumura

(10) Patent No.: US 7,465,206 B2
(45) Date of Patent: Dec. 16, 2008

(54) LIFE SAVING APPARATUS

(75) Inventor: Kuniaki Matsumura, Osaka (JP)

(73) Assignee: Takashina Life Preservers Co., Ltd., Osaka (JP)

( * ) Notice: Subject to any disclaimer, the term of this patent is extended or adjusted under 35 U.S.C. 154(b) by 0 days.

(21) Appl. No.: 11/526,848

(22) Filed: Sep. 25, 2006

(65) Prior Publication Data

US 2007/0072498 A1 Mar. 29, 2007

(30) Foreign Application Priority Data

Sep. 27, 2005 (JP) ..... 2005-280146

(51) Int. Cl.
*B63C 9/08* (2006.01)

(52) U.S. Cl. ..... 441/108; 441/113

(58) Field of Classification Search ..... 441/108, 441/113

See application file for complete search history.

(56) References Cited

U.S. PATENT DOCUMENTS 2,001,384 A * 5/1935 Garvey ..... 441/111
5,516,320 A * 5/1996 LaPlant ..... 441/106
5,855,454 A * 1/1999 Courtney et al. ..... 405/186
6,053,790 A * 4/2000 Langford ..... 441/129
6,106,348 A * 8/2000 Loisel ..... 441/108

FOREIGN PATENT DOCUMENTS

JP 2004-098936 4/2004
JP 2004-196002 7/2004
JP 2005-053342 3/2005

* cited by examiner

*Primary Examiner*—Stephen Avila
(74) *Attorney, Agent, or Firm*—The Webb Law Firm

(57) ABSTRACT

The invention provides a life saving apparatus which allows a wearer to readily assume a rearwardly inclined floating posture on the water surface under an inflated condition of a float body. The life saving apparatus includes a float body 2 configured to surround the torso of a wearer P under an inflated condition of the float body and an attaching body 3 to be attached to the waist of the wearer P. The float body 2 and the attaching body 3 are connected to each other at a connecting position on the back side of the wearer's P body via an extension member 5 having a predetermined length. The float body 2 and the attaching body 3 are connected, with a shorter inter-distance than the predetermined length of the extension member 5, at a position forwardly of the connecting position on the back side of the wearer's P body.

9 Claims, 6 Drawing Sheets

LIFE SAVING APPARATUS

BACKGROUND OF THE INVENTION

1. Field of the Invention

The present invention relates to a life saving apparatus having an inflatable float body which is not obstructive to a wearer's action under a normal inoperative condition of the apparatus.

2. Description of the Related Art

As an example of a life saving apparatus having an inflatable float body, the Japanese Patent Application "Kokai" No. 2004-98936 discloses a life saving apparatus 101 having a construction as follows. Namely, this conventional life saving apparatus 101, as shown in FIGS. 5 and 6, includes a cover 102, a float body 103 and a gas charging device 104. The cover 102 has a flat laterally elongate shape, and a pair of buckles 106 are provided at opposed lateral ends of the cover 102 via belts 105. By engaging the buckles 106 at the opposed ends with each other, the cover 102 can be attached around the waist of a wearer P. Further, the cover 102 includes surface fasteners 107 at upper end lower edges thereof. Then, as the cover 102 houses the float body 103 therein, the upper and lower edges of the cover 102 are laid one on the other for mutual engagement, thus forming a flattened tubular assembly.

The float body 103 is a substantially U-shaped body forming a discontinuity (opening) on the front side of the wearer's P body when the float body 103 is inflated. Further, this float body 103 is permanently fixed, by means of adhesion or the like, to the cover 102. Under its un-inflated condition, the float body 103 is folded and housed inside the flattened tubular cover 102. At opposed ends of the float body 103, there are provided a pair of buckles 109 via belts 108. As the buckles 109 at the opposed ends are engaged with each other, inadvertent detachment of the float body 103 from the wearer's P body is effectively prevented. The gas charging device 103 is attached to the float body 103. In response to detection of water intrusion or a manual operation thereof, the gas charging device 103 is activated to charge gas such as carbon dioxide gas into the float body 103 for its inflation.

When a wearer floats on the surface of water with the aid of the buoyancy of the life saving apparatus, it is generally believed that the ideal posture of this floating wearer is a rearwardly inclined posture, with the face of the wearer being oriented obliquely upward. With the above-described construction of the conventional life saving apparatus 101, however, it has proven difficult for the wearer P to assume such rearwardly inclined floating posture with good stability on the water surface, under the floated condition of the float body 103. More particularly, with this conventional life saving apparatus 101, the float body 103 is fixed integrally with the cover 102 attached around the waist of the wearer P. On the other hand, it is not possible to completely fix this cover 102 to the waist of the wearer P. Accordingly, when the wearer P falls into water and the float body 103 is inflated, as illustrated in FIG. 7, by the buoyancy of the float body 103, the entire cover 102 containing the float body 103 therein tends to be displaced upward as far as to the underarms of the wearer P. As a result, the axis X of the body of the wearer P will be aligned substantially perpendicular to the water surface, so that even with a slight loss of body balance, the wearer P may inadvertently assume a forwardly inclined posture, under which posture the wearer's face may easily dive into water.

SUMMARY OF THE INVENTION

The present invention has been made in view of the above-described state of the art. The primary object of the present invention is to provide a life saving apparatus which allows a wearer to readily assume a rearwardly inclined floating posture on the water surface under the inflated condition of the float body.

For accomplishing the above-noted object, according to the present invention, there is proposed a life saving apparatus comprising:

a float body configured to surround the torso of a wearer under an inflated condition of the float body; and an attaching body to be attached to the waist of the wearer;

wherein said float body and said attaching body are connected to each other at a connecting position on the back side of the wearer's body via an extension member having a predetermined length, and said float body and said attaching body are connected, with a shorter inter-distance than said predetermined length of the extension member, at a position forwardly of said connecting position of the extension member.

Incidentally, in this disclosure throughout, the term "forwardly" refers to the direction toward the stomach side of the wearer's body, whereas the term "rear" or "rearward" refers to the direction toward the back side of the wearer's body. Further, the language "around the torso of the wearer" means at least a portion of the perimeter of the entire wear's body (or torso). Similarly, the language "around the waist of the wearer" is used to refer to an area which is smaller than the above-defined "around the torso of the wearer" area and which is near the wearer's waist.

With the above-described characterizing feature of the invention, on the back (rear) side of the wearer, the float body is allowed to move more upward than the wear's waist level by a distance corresponding to the length of the extension member. On the other hand, at the position forwardly of this connecting position of the extension member, the float body is connected (to the attaching body) with an inter-distance shorter than the length of the extension member, so that the float will be vertically restricted to a position relatively near the wearer's waist to which the attaching body is attached. As a result, the float body assumes a condition forwardly inclined relative to the body axis of the wearer (i.e. the stomach side of the float body assumes a lower position whereas the back side of the float body assumes an upper position). And, on the water surface level, the float body assumes a horizontal posture, so that the wearer naturally assumes a rearwardly inclined posture. Consequently, the floating posture of the wearer on the water surface under the inflated condition of the float body can be readily stabilized as the rearwardly inclined posture.

Preferably, the length of the extension member and said distance shorter than this length are set such that under the inflated condition of the float body, the body axis of the wearer on the water surface forms a rearward angle ranging from 30 to 60 degrees relative to the water surface.

With this construction, the wearer can more readily assume the above-described ideal rearwardly inclined posture on the water surface under the inflated condition of the float body.

Still preferably, said position forwardly of said connecting position of the extension member is set forwardly of the right and left sides of the wear's body.

With the above construction, the float body and the attaching member can be connected with the shorter distance than the length of the extension member at a position forwardly distant from the connecting position of the extension member by a distance grater than a predetermined distance. Hence, this construction can contribute an even greater stability in the rearwardly inclined posture floating on the water surface under the inflated condition of the float body.

Preferably, said float body has a greater volume on the stomach side thereof than the back side thereof and has also different volumes between the right and left sides on the stomach side thereof.

With the above-described construction, as the stomach side volume of the float body is greater than the back side volume thereof, when the wearer of the life saving apparatus drops into water, the float body will tend to float up with its stomach side portion upward. Further, as the right and left side volumes on the stomach side portion of the float body are differentiated from each other, the float body will be "urged" to spin in a direction to cause the right or left greater volume side thereof to be oriented upward. Therefore, even when the wearer drops into water with his/her stomach side facing downward, the float body will help the wearer to quickly assume the stomach side upward posture. Namely, the above construction can contribute to improvement of self-posture pivotal restoring performance. Consequently, regardless of the dropping posture of the wearer into the water, the life saving apparatus having the above-described construction allows the wearer to quickly assume the rearwardly inclined posture.

Still preferably, said float body has a substantially C-shape surrounding the torso of the wearer under the inflated condition thereof and having a discontinuity (opening) at a portion thereof, with opposed open ends opposed at said discontinuity being formed as concave and convex portions engageable with each other.

With the above-described construction, during the inflating process of the float body, the wearer's body can be fitted inside the C-shaped ring like float body through the discontinuity (opening) thereof. So, the float body can be inflated to surround the torso of the wearer, without needing any special operation. Therefore, the apparatus can speedily and reliably support the body of the wearer for floating his/her body in water. Further, as the opposed open ends of this float body are engageable with each other, the shape of the float body can be stabilized, hence, the floating posture of the wearer can be stabilized easily also.

Preferably, the life saving apparatus further comprises a cover body detachably attachable to said attaching body and capable of accommodating therein said float body under its un-inflated condition.

With the above construction, under its un-inflated condition, the float body can be accommodated within the cover body. Hence, the floating body can be protected against damage. Further, the appearance of the life saving apparatus under the un-inflated condition can be improved. Moreover, as the cover body is detachable from the attaching body, the cover body alone can be readily detached for cleaning or replacement.

DESCRIPTION OF THE PREFERRED EMBODIMENTS

Preferred embodiments of the present invention will be described with reference to the accompanying drawings.

Figure 1:
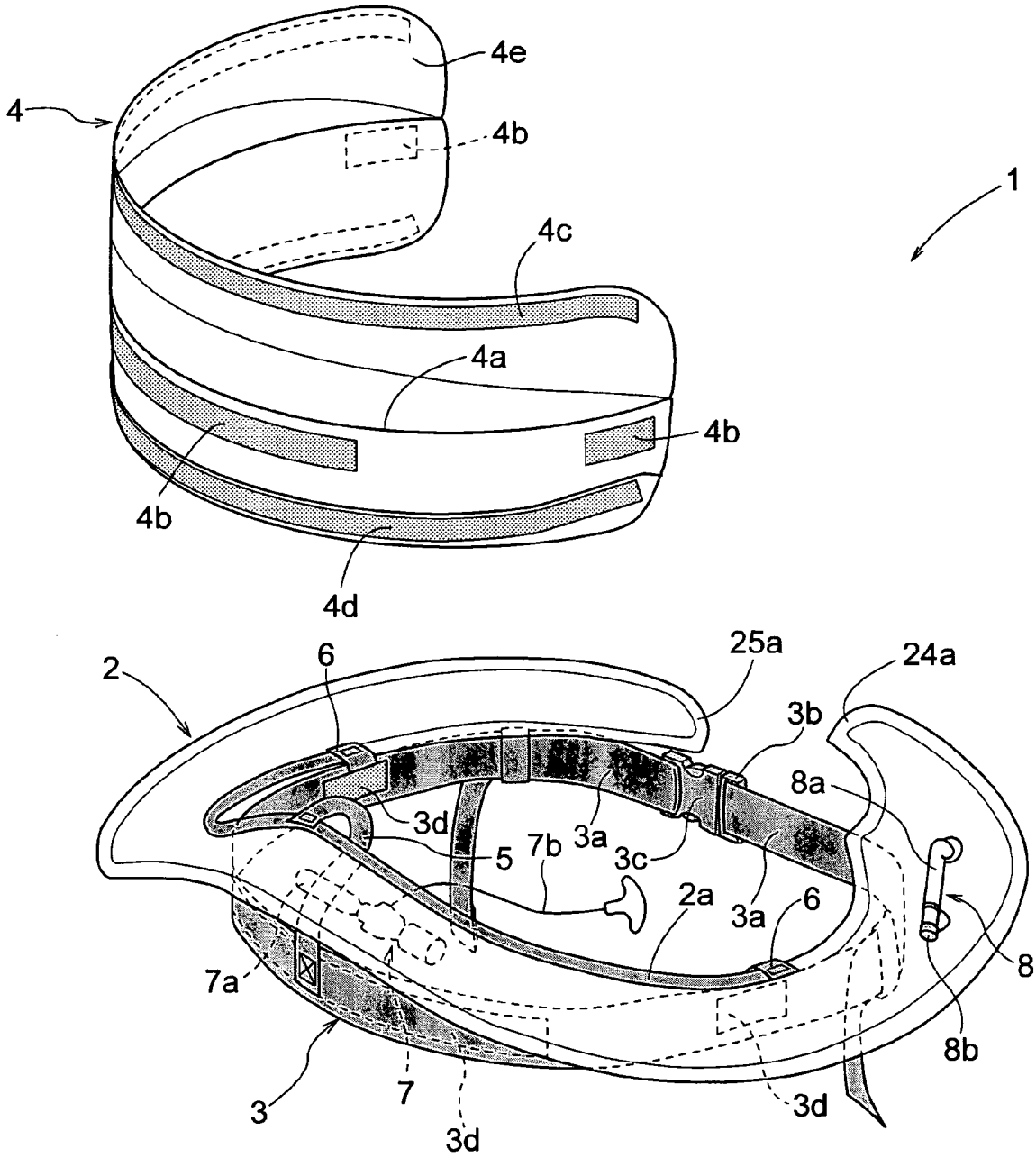
FIG. 1 is an exploded perspective view of a life saving apparatus according to one preferred embodiment of the present invention.
Figure 2:
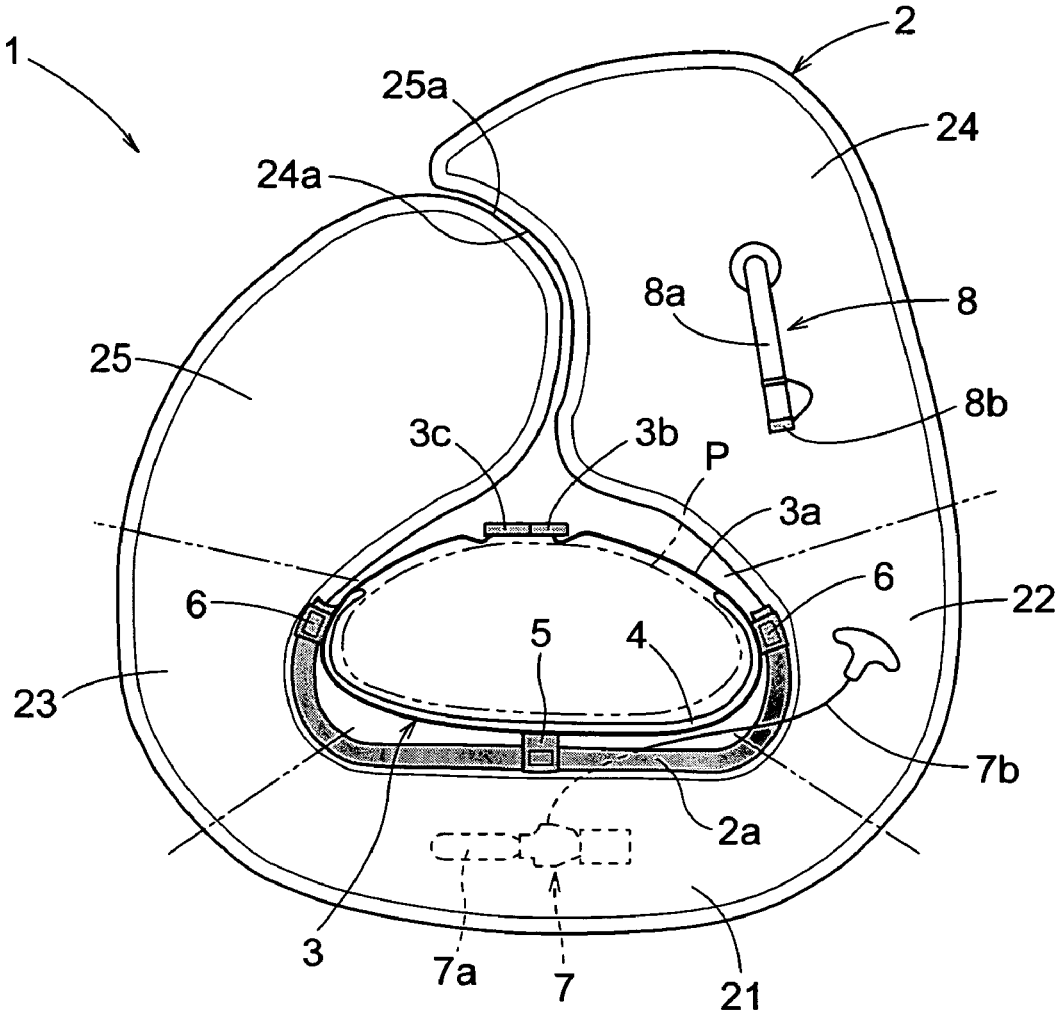
FIG. 2 is a plan view showing the life saving apparatus according to the embodiment when the float body is inflated.
Figure 3:
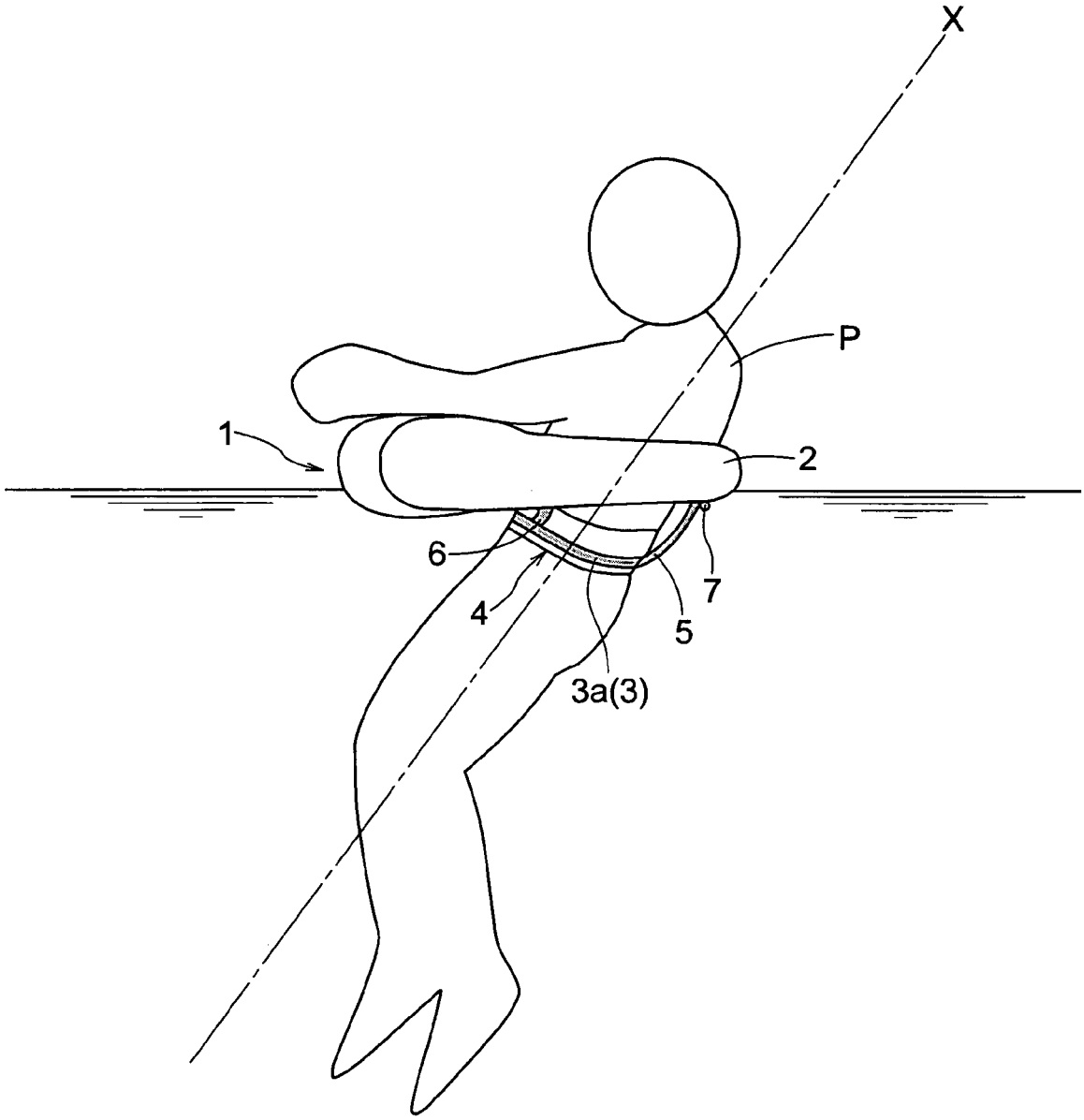
FIG. 3 is a side view showing a floating posture of a wearer in water and near water surface when the wearer is wearing the life saving apparatus of the invention.
Figure 4:
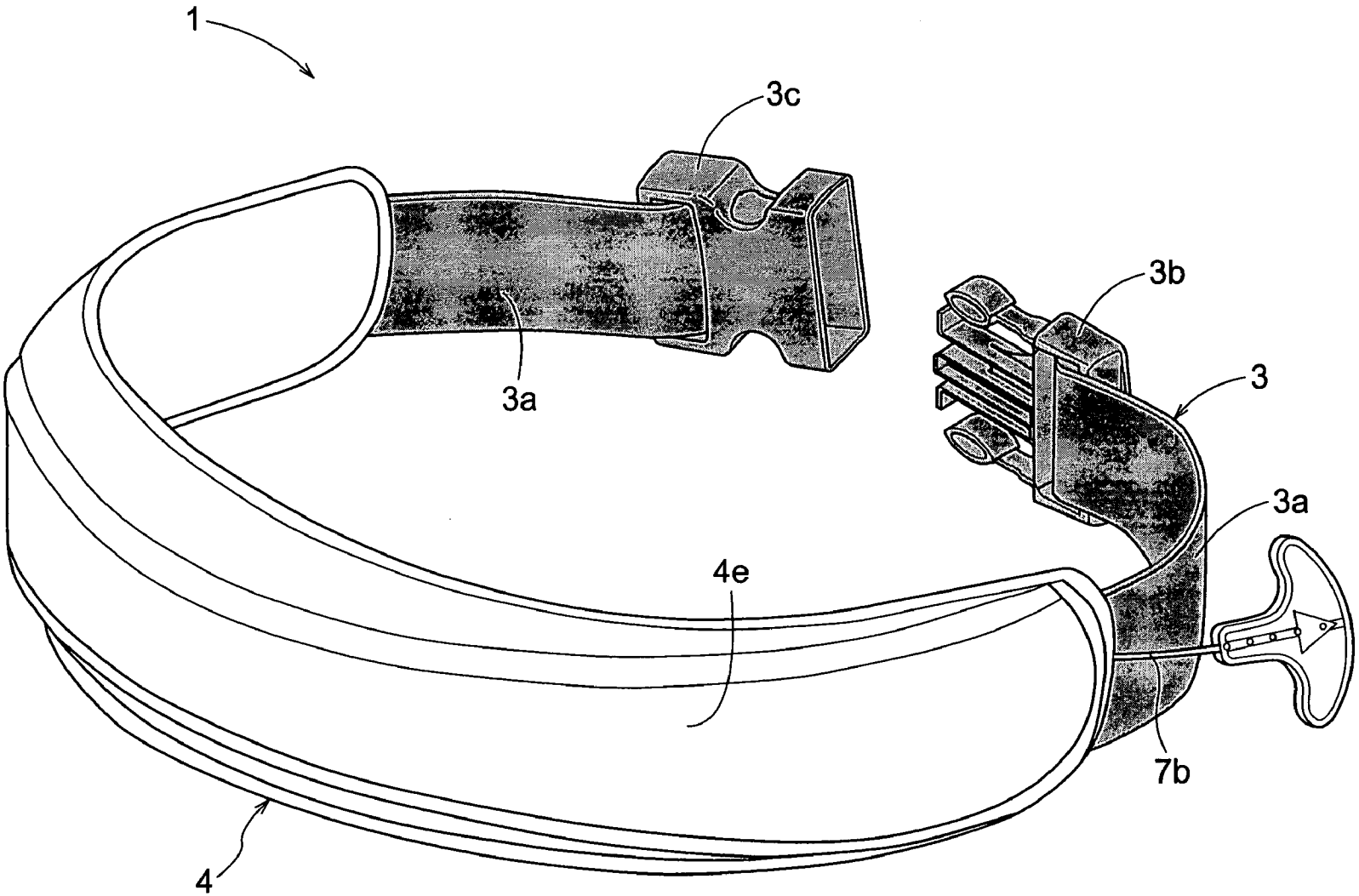
FIG. 4 is a perspective view showing the life saving apparatus of the invention when the un-inflated float body is folded and accommodated within the cover body.
Figure 5:
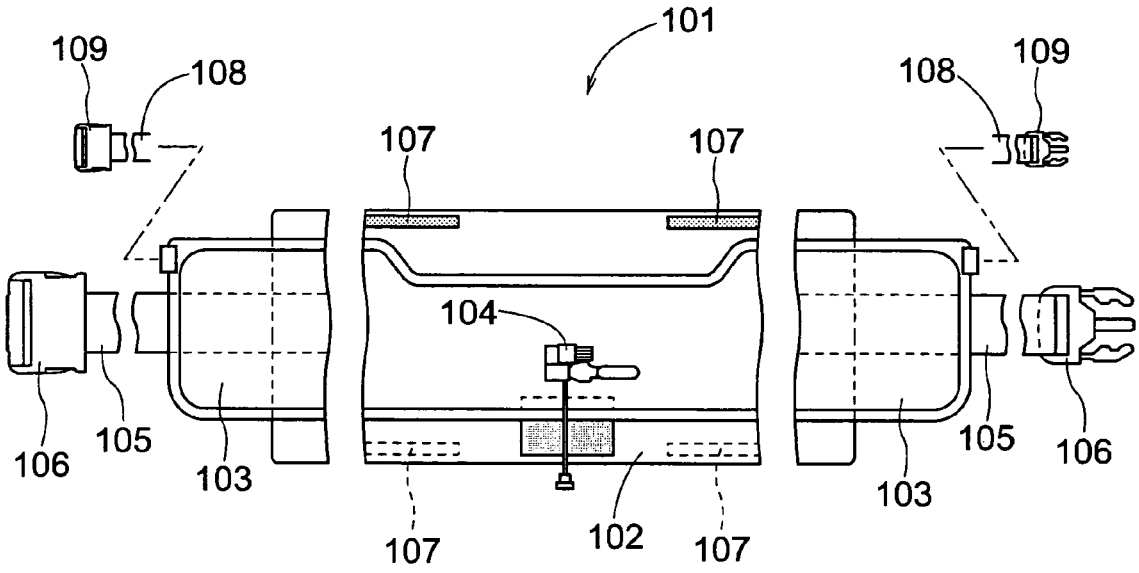
FIG. 5 is a development drawing of a life saving apparatus according to the background art.
Figure 6:
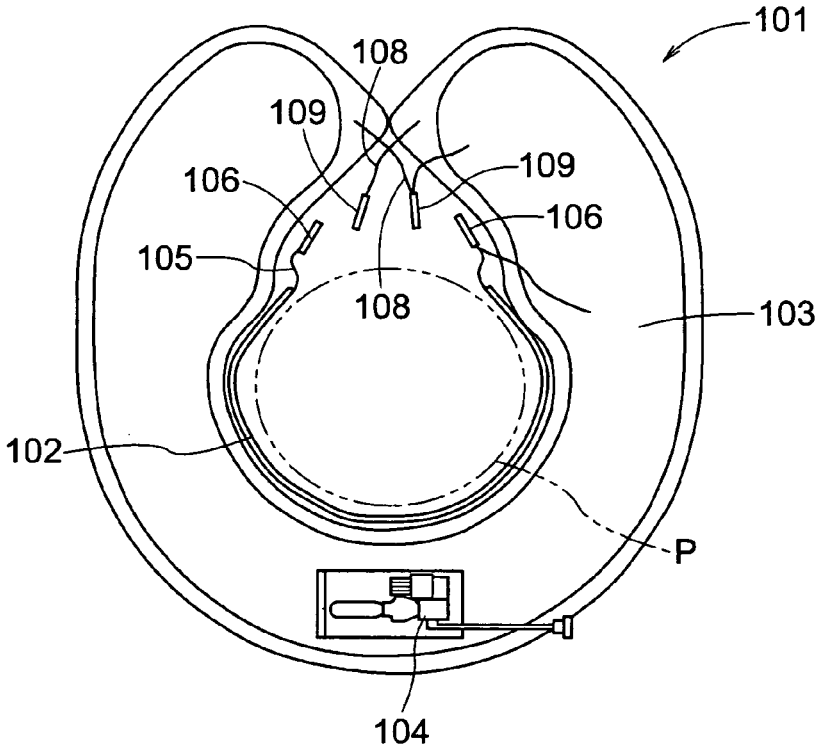
FIG. 6 is a plan view of the life saving apparatus relating to the background art when its float body is floated.
Figure 7:
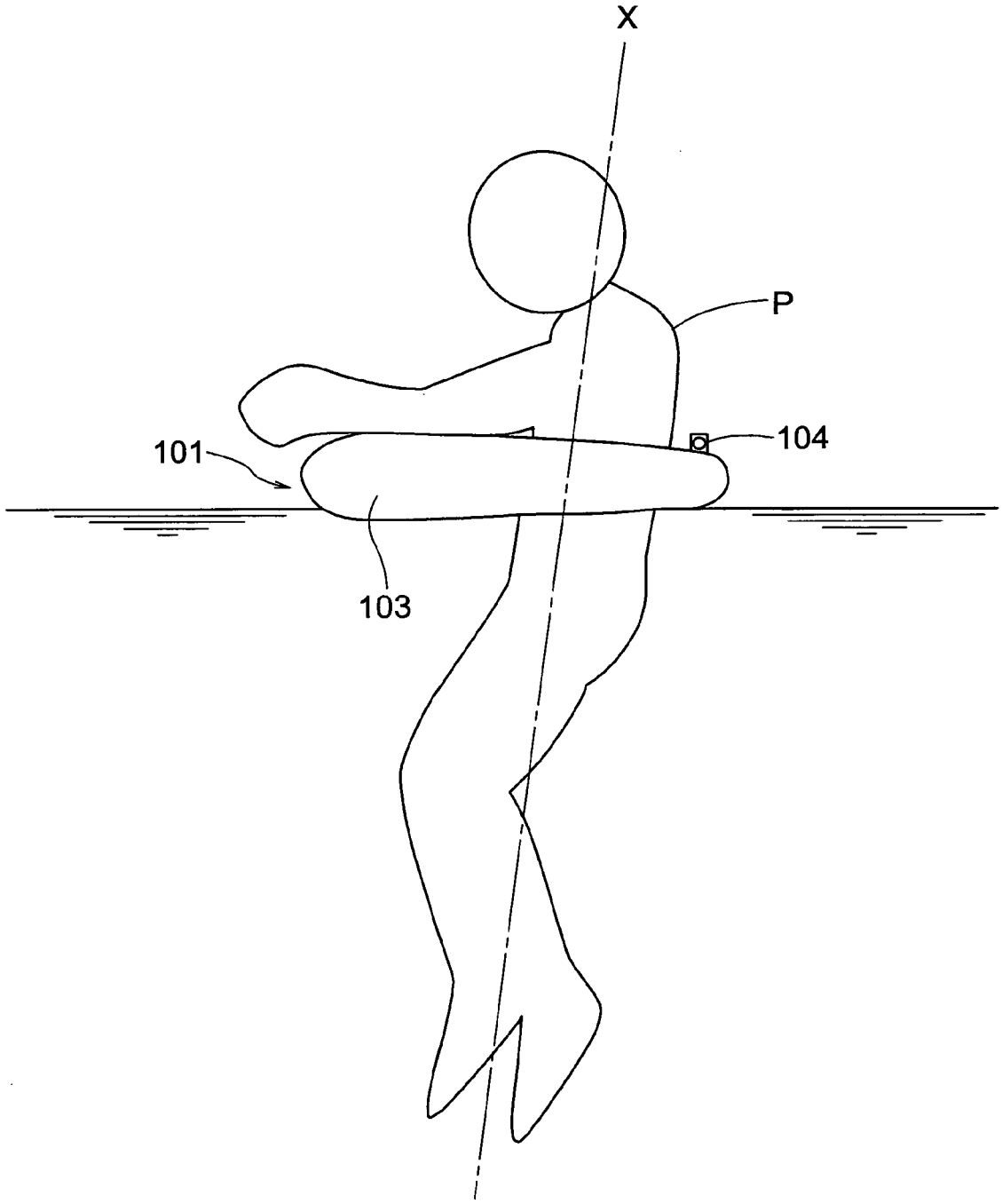
FIG. 7 is a side view showing a floating posture of a wearer in water and near water surface when the wearer is wearing the life saving apparatus relating to the background art.

FIG. 1 is a perspective view of a life saving apparatus 1 according to one preferred embodiment of the present invention. In this figure, a float body 2 is under an un-inflated condition and a cover 4 is detached. FIG. 2 is a plan view showing the life saving apparatus 1 when the float body 2 is inflated. FIG. 3 is a side view showing a floating posture of a wearer P in water and near water surface when the wearer is wearing the life saving apparatus 1. FIG. 4 is a perspective view showing the life saving apparatus 1 when the un-inflated float body 2 is folded and accommodated within the cover 4.

As shown in these figures, the life saving apparatus 1 relating to the present embodiment includes, as its principal components, the float body 2, an attaching belt 3 and the cover 4. Next, these components will be described in details respectively.

1. Float Body

The float body 2 is a bag-like sealed tubular body (or "air-bladder") which can be inflated with charging of gas therein. As shown in FIG. 2, under its inflated condition, the float body 2 assumes a shape surrounding the torso of the wearer P. In this particular embodiment, the float body 2 has a substantially C-shape with a discontinuity (opening in its longitudinal ring-like extension) at a portion forwardly of the wearer's P stomach side. Further, along an inner peripheral edge of the float body 2, at an area extending from the back side to the right and left sides, there is provided a reinforcing band-like portion 2*a* for connection with the attaching belt 3 which will be detailed later. As the float body 2 has the shape having such discontinuity at one portion thereof, this float body 2 when accommodated within the cover 4 as illustrated in FIG. 4, the body of the wearer P can be fitted through the discontinuous portion (opening) to be inside the annular float body 2 and the float body 2 can be inflated to surround the torso of the wearer P without this wearer P having to effect any special operation. Therefore, when the wearer P falls into water, the apparatus can speedily and reliably support the body of the wearer P to float it in water as shown in FIG. 3. For the sake of convenience of following discussion, the float body 2 is understood to consist of five areas as divided by two-dot lines in FIG. 2. Namely, an area corresponding to the back side of the wearer P is referred to as an intermediate portion 21. An area extending forwardly from the right end of the intermediate portion 21 and located on the left side of the wearer P is referred to as a right base portion 22. An area extending forwardly from the left end of the intermediate portion 21 and located on the left side of the wearer P is referred to as a left base portion 23. An area extending forwardly from the right base portion 22 and located on the right forward side of the stomach of the wearer P is referred to as a right arm portion 24. Lastly, an area extending forwardly from the left base portion 23 and located on the left forward side of the stomach of the wearer P is referred to as a left arm portion 25. Incidentally, the borders between these areas or portions denoted with the two dot lines in FIG. 2 are provided only for general illustration suitable for the discussion purpose, not to be provided with absolute precision.

In the instant embodiment, the right arm portion 24 and the left arm portion 35 corresponds respectively to the "stomach side portion" in the invention, the intermediate portion 21 corresponds to the "back side portion" in the invention.

The float body 2 is constructed such that a sum-up volume of the right arm portion 24 and the left arm portion 25 is sufficiently greater than the volume of the intermediate portion 21. With this construction, when the wearer P falls into water, the float body 2 can float with the stomach side of the wearer P facing upward. Further, the volume of the right arm portion 24 and the volume of the left arm portion 25 are set different from each other. More particularly, the volume of the right arm portion 24 is set greater than the volume of the left arm portion 25. With this, when the wearer P falls into water, the float body 2 will automatically "spin" in the direction to orient the right arm portion 24 having the greater volume upward, thus speedily orienting the stomach side front portion of the wearer P upward. Namely, with the above-described construction of the float body 2, even when the wearer P falls into water with his/her stomach side facing downward, the float body 2 can speedily assume the posture of orienting its right arm portion 24 and left arm portion 25 as the stomach side portions upward. In this manner, the self pivotal, posture restoring performance of the apparatus can be improved. Consequently, with this life saving apparatus 1, regardless of the posture of the wearer P falling into water, the apparatus allows the wearer P to assume the rearwardly inclined posture as shown in FIG. 3 in a speedily and stable manner.

Further, the float body 2 is configured such that under its inflated condition, this inflated float body 2 surrounds the torso of the wearer P, with its opposed ends opposed to each other at the discontinuous portion (opening) at the stomach front side, namely, the leading end of the right arm portion 24 and the leading end of the left arm portion 25 may come into contact in opposition with each other. Further, in this, the leading end of the right arm portion 24 and the leading end of the left arm portion 25 are formed as mating concave and convex portions which can be engaged with each other. More particularly, the leading end of the right arm portion 24 is formed with an arcuate recess 24*a*, whereas the leading end of the left arm portion 25 is formed with an arcuate projection 25*a* corresponding thereto. With this shape arrangement of the float body 2, as shown in FIG. 2, under the inflated condition of the float body 2, the leading end of the right arm portion 24 and the leading end of the left arm portion 25 can be fitted with each other, whereby the shape of the inflated float body 2 can be stabilized, hence, the floating posture of the wearer P can be stabilized accordingly.

To the lower face of the intermediate portion 21 of the float body 2, there is attached a gas charging device 7 for feeding gas into the float body 2 for inflating this body. This gas charging device 7 can be any conventional gas charging device. In this particular embodiment, the gas charging device 7 includes a gas cylinder 7*a* storing therein compressed gas such as carbon dioxide, a feeding controller having a communicating hole communicating with the inside of the float body 2 and operable, when activated, to feed the gas inside the cylinder 7*a* into the float body 2, an automatic activating device for automatically activating the feeding controller upon detection of falling of the wearer P into water, and a manual activating device for activating the feeding controller in response to an operation on a control cord 7*b*. Incidentally, the disposing position of this gas charging device 7 is not particularly limited. In this embodiment, however, the device 7 is disposed at a position on the lower face of the intermediate portion 21, which is an example of position hardly obstructive to a movement of the wearer P. According to another preferred embodiment of the invention, this gas charging device 7 can omit the automatic activating unit, and can be constructed as a manually operable gas charging device designed to inflate the float body 2 in response to a manual operation of the control rod 7*b* alone.

On the upper side of the right arm portion 24 of the float body 2, there is provided a charging amount adjusting tube 8. In this embodiment, this charging amount adjusting tube 8 includes a tube body 8*a* communicating with the inside of the float body 2, a cap 8*b* which can be fitted over the leading end opening of the tube body 8*a* for closing it, and a check valve (not shown) incorporated within the tube body 8*a* adjacent its leading end opening and allowing only unidirectional passage of the gas flowing into the float body 2. In operation, if the wearer P finds the amount of inflation of the float body 2 insufficient, the wearer P then can breathe into the charging amount adjusting tube 8 for the desired additional inflation. Conversely, if the wearer P finds the amount of inflation excessive, the wearer P can open up the check valve to discharge a desired amount of the gas in the float body 2 to the outside. In these manners, the wearer P can freely adjust the amount (or degree) of inflation of the float body 2. The disposing position of the charging amount adjusting tube 8 is not particularly limited, as long as its position allows the wearer P to easily breathe into the tube. Therefore, this charging amount adjusting tube 8 can be provided on the upper side of the left arm portion 25.

2. Attaching Belt

The attaching belt 3 is a belt attached around the wearer's waist. In this embodiment, the belt 3 includes a belt body 3*a* and a mating pair of buckles 3*b*, 3*c* as a mutually engageable engaging device. Each buckle 3*b*, 3*c* includes a length adjusting mechanism for adjusting the length of the belt body 3*a*. As shown in FIG. 3 also, the wearer P will put the belt body 3*a* around his/her waist and then engage the buckles 3*b*, 3*c* with each other and adjust the length of the belt body 3*a*, whereby the attaching belt 3 can be firmly and reliably attached to the wearer's P body without risk of displacement thereof from the waist. Further, in this embodiment, along the inner periphery (on the side of the wearer P) of the belt body 3*a*, there are provided surface fasteners 3*d* as an attaching tool for detachable attachment of the cover 4. In the example shown in the drawing, in correspondence with the disposition of attaching surface fasteners 4*b* provided in the cover 4 to be described later, the surface fasteners 3*d* are provided at three positions. And, as each surface fastener 3*d* comes into engagement with each attaching surface fastener 4*b* of the cover 4, the cover 4 is attached to the attaching belt 3.

Incidentally, in this particular embodiment, the attaching belt 3 corresponds to "attaching body" of the invention.

3. Connection Between Float Body and Attaching Belt

The float body 2 and the attaching body 3 are connected to each other at a position on the back side of the wearer P via an extension belt 5 having a predetermined length. And, these bodies 2 and 3 are connected with a shorter inter-distance than the fixed length of the extension belt 5 at a position forwardly of the above-described connecting position of the extension belt 5. Preferably, this position forwardly of the connecting position of the extension belt 5 is a position forwardly of either right or left side of the wearer P. In the instant embodiment, as shown in FIGS. 1 and 2, the reinforcing band-like portion 2*a* of the float body 2 and the attaching belt 3 are connected via the extension belt 5 which is provided adjacent the bask side center portion of the wearer P and a pair of connecting belts 6 which are provided adjacent the right and left sides of the wearer P and provided forwardly of the connecting position of the extension belt 5. And, each connecting belt 6 has a shorter length than the extension belt 5. As shown in FIG. 3, these lengths of the extension belt 5 and the connecting belts 6 are set such that under the inflated condition of the float body 2, the wearer P may assume an ideal rearwardly inclined posture as floating in water. More particularly, these lengths are set such that the axis X of the body of the wearer P may be rearwardly inclined with an angle from 30 to 60 degrees, preferably from 40 to 60 degrees, relative to the water surface. Though the actual lengths of the extension belt 5 and the connecting belts 6 for achieving such condition may differ, depending on the shape of each wearer P's body, the connecting belt 6 can advantageously be constructed such that the inter-distance between the reinforcing band-like portion 3*a* of the float body 2 and the attaching belt 3 may be from 0 to 10 cm, more preferably, from 0 to 3 cm. Whereas, the length of the extension belt 5 can advantageously constructed such that the inter-distance between the reinforcing band-like portion 2*a* of the float body 2 and the attaching belt 3 may be from 15 to 35 cm, more preferably, from 20 to 30 cam longer than the connecting distance provided by the connecting belt 6. The extension belt 5 and the connecting belts 6 have their respective upper ends affixed to the reinforcing band-like portion 2*a* of the float body 2 and their respective lower ends affixed to the attaching belt 3. These fixations can be realized by means of sewing, adhesive bonding, etc.

With the above-described connecting length or distance arrangement between the float body 2 and the attaching body 3, on the back (rear) side of the wearer P, the float body 2 is allowed to move more upward than the waist of the wearer P by the distance corresponding to the length of the extension belt 5. On the other hand, on the more front or forward side than the connecting position provided by the extension belt 5, as the float body 2 is connected by means of the connecting belts 6 shorter than the extension belt 5, the float body 2 is physically restricted to a position relatively close to the waist of the wearer P around which the attaching belt 3 is attached. Therefore, relative to the body axis X of the wearer P, the float body 2 will assume a forwardly inclined posture, namely, the stomach side thereof assuming a lower position and the back side thereof assuming an upper position. And, as illustrated in FIG. 3, when the wearer P is afloat in water, the float body 2 assumes a horizontal posture as a matter of course, so that the body of the wearer P will naturally assume the ideal rearwardly inclined posture. As a result, the floating posture of the wearer P in water under the inflated condition of the float body can be readily stabilized to the rearwardly inclined posture.

In this embodiment, the extension belt 5 corresponds to the "extension member" in the invention. Incidentally, instead of this extension belt 5, an extension string, wire, chain, cord, etc. may be employed.

4. Cover

This cover 4 is detachably attachable to the attaching belt 3 and can accommodate therein the un-inflated float body 2. In the present embodiment, as shown in FIG. 1, the cover 4 is provided like a band member having a greater width than the attaching belt 3. Further, this cover 4 has a folding line 4*a* at the width-wise (vertical direction in FIG. 1) center portion thereof for allowing double-folding of this cover 2. And, downwardly (in FIG. 1) of this folding line 4*a* and at the three positions adjacent the center portion and opposed side portions in the longitudinal direction, there are provided the attaching surface fasteners 4*b* for attachment to the attaching belt 3. As described hereinbefore, each attaching surface fastener 4*b* comes into engagement with each one of the surface fasteners 3*d* provided at the three positions in the inner peripheral side (the side of the wearer P) of the attaching belt 3. With this, the cover 4 is detachably attached to the inner peripheral side (the side of the wearer P) of the attaching belt 3 (see FIGS. 1-3). In this way, as the cover 4 is designed to be detachably attachable to the attaching belt 3, the cover 4 alone can be readily detached for its cleaning, replacement, when desired.

Further, along the upper edge of the cover 4, there is provided an upper edge surface fastener 4*c* and along the lower edge of the cover 4, there is provided a lower edge surface fastener 4*d*. Then, the cover 4 can be double-folded along the folding line 4*a* and the upper edge surface fastener 4*c* and the lower edge fastener 4*d* can be superposed and engaged with each other, whereby the cover can be formed into a flattened tubular body. Therefore, by folding the un-inflated float body 2 to be accommodated inside the cover 4 and then folding this cover 4 into two along the folding line 4*a* and engaging the upper edge surface fastener 4*c* and the lower edge surface fastener 4*d* with each other, the un-inflated float body 2 can be entirely accommodated within the cover, as illustrated in FIG. 4. In this respect, it may be advantageous to keep the leading end of the control cord 7*b* outside either end of the cover 4 so as to facilitate a manual operation by the wearer P for inflating the float body 2. Incidentally, the condition illustrated in this FIG. 4, i.e. the condition of the float body 2 being accommodated within the cover 4, is the normal condition of the life saving device 1. Under this normal condition, as the un-inflated float body 2 is accommodated within the cover 4, the float body 2 can be protected against damage. For improvement of appearance of this life saving apparatus 1 under the normal condition, advantageously, a desired ornamental design may be provided on the outer side face 4*e* of the cover 4.

In this embodiment, the cover 4 corresponds to "cover body" of the invention.

Other Embodiments (1) In the foregoing embodiment, as the "attaching body", there is employed as the attaching belt 3 which is attached around the waist of the wearer P. However, the "attaching body" relating to the invention is not limited to such belt-like member. Namely, the "attaching body" can be any member having a portion to be attached around the waist of the wearer P. For instance, according to a further preferred embodiment of the invention, this attaching body can be formed integral with a garment such as a bathing suit, a wet or diving suit, etc. to be fitted around the wearer's P waist.

(2) In the foregoing embodiment, there was described the construction of the float body 2 in details. However, the construction of the float body used in the life saving apparatus of the invention is not limited thereto. According to a further embodiment of the invention, the float body can have a U-shaped, or an angular hooked shape in its plan view. Further, the float body can be a circular body without any discontinuity (i.e. "a closed circle"). When the float body is constructed without any discontinuity, it will be appropriate for the life saving apparatus to be attached in advance so that the wearer P may be held within the center hole of the float body under its un-inflated condition.

(3) In the foregoing embodiment, only one extension belt 5 as the extension member is provided adjacent the back side center portion of the wearer P. The invention is not limited to this particular construction of the extension member of the foregoing embodiment. For instance, according to a further embodiment of the invention, a plurality of extension members may be provided on the back side of the wearer P or the extension member may be disposed with an offset to either the right or left side from the back side center portion.

(4) In the foregoing embodiment, the float body 2 and the attaching belt 3 are connected to each other via the connecting belts 6 adjacent the right and left sides of the wearer P forwardly of the connecting position of the extension belt 5. The connection construction between the float body and the attaching body of the life saving apparatus of the invention is not limited thereto. The connecting positions between the float body and the attaching member may be other positions forwardly of the right and left sides of the wearer P. For instance, according to a further embodiment of the present invention, these positions may be adjacent the stomach side of the wearer P. According to a still further embodiment of the invention, this connection between the float body and the attaching member forwardly of the connecting position of the extension cable member can omit use of the connecting belts 6 or the like. For instance, the float body and the attaching body can be directly affixed to each other.

(5) In the foregoing embodiment, there is provided the cover 4 for accommodating the un-inflated float body 2 under the normal condition. However, this cover 4 is not an essential requirement for the "life saving apparatus" of the invention. According to a further embodiment of the invention, the life saving apparatus can omit the cover 4.

The invention claimed is:

1. A life saving apparatus comprising:

an inflatable float body configured to surround the torso of a wearer under an inflated condition of the float body, the float body including a back side portion corresponding to the back side of the wearer's body, a right base portion and a left base portion extending forwardly from the back side portion on opposing sides of the wearer, a right arm portion extending forwardly from the right base portion and a left arm portion extending forwardly from the left base portion;

an attaching body to be attached to the waist of the wearer;

an extension member connecting the attaching body to the float body at a connecting position on the back side portion, the extension member having a predetermined length; and a plurality of connecting members connecting the attaching body to the float body at a plurality of connecting positions on the float body forward of the back side portion, the connecting members having a length shorter than the predetermined length of the extension belt, wherein the float body and the attaching body are connected at the connection position on the back side portion via the extension member to be spaced from each other by a distance corresponding to the length of the extension member and the float body and the attaching body are connected at the connection positions on the float body forward of the back side portion via the connecting members to be spaced from each other by a distance shorter than the length of the extension member, wherein the right arm portion and the left arm portion of the float body extend forward of the torso of the wearer and define a stomach side portion of the float body, the stomach side portion of the float body having a volume greater than the back side portion of the float body under the inflated condition of the float body, and wherein one of the right arm portion and the left arm portion of the float body has a volume greater than a volume of the other of the right arm portion and the left arm portion under the inflated condition of the float body.

2. The life saving apparatus according to claim 1, wherein the length of the extension member and the length of the connecting members are set such that under the inflated condition of the float body, the body axis of the wearer on the water surface forms a rearward angle ranging from 30 to 60 degrees relative to the water surface.

3. The life saving apparatus according to claim 1, wherein the connecting positions on the forward area are set forwardly of the right and left sides of the wearer's body.

4. The life saving apparatus according to claim 1, further comprising a cover body detachably attachable to the attaching body and capable of accommodating therein the float body under its un-inflated condition.

5. The life saving apparatus according to claim 1, wherein the float body has a substantially C-shape surrounding the torso of the wearer under the inflated condition of the float body and has a discontinuity defined between opposing ends of the right arm portion and the left arm portion, with the opposing ends of the right arm portion and the left arm portion at the discontinuity being formed as concave and convex portions engageable with each other.

6. The life saving apparatus according to claim 5, wherein the discontinuity is defined at a location forward of the torso of the wearer.

7. The life saving apparatus according to claim 1, wherein the attaching body comprises a belt body having a buckle adapted for attaching opposing ends of the belt body.

8. The life saving apparatus according to claim 1, wherein the connecting position on the back side portion of the float body moves above the attaching body a distance corresponding to the length of the extension member and each of the plurality of connecting positions on the float body forward of the back side portion move above the attaching body a distance corresponding to the length of a respective one of the plurality of connecting members.

9. A life saving apparatus comprising:

a float body configured to surround the torso of a wearer under an inflated condition of the float body, the float body including a back side portion corresponding to the back side of the wearer's body and a forward portion extending forwardly of the back side portion around both sides of the wearer;

an attaching body to be attached to the waist of the wearer;

an extension member connecting the attaching body to the float body at a connecting position on the back side portion, the extension member having a predetermined length; and a plurality of connecting members connecting the attaching body to the float body at a plurality of connecting positions on the forward portion of the float body, the connecting members having a length shorter than the predetermined length of the extension belt, wherein the float body and the attaching body are connected at the connection position on the back side portion via the extension member to be spaced from each other by a distance corresponding to the length of the extension member and the float body and the attaching body are connected at the connection positions on the float body forward of the back side portion via the connecting members to be spaced from each other by a distance shorter than the length of the extension member, and wherein the connecting position on the back side portion of the float body moves above the attaching body a distance corresponding to the length of the extension member and each of the plurality of connecting positions on the forward portion of the float body move above the attaching body a distance corresponding to the length of a respective one of the plurality of connecting members.

* * * * *